United States Patent [19]

Hoyer

[11] 4,203,586

[45] May 20, 1980

[54] MULTIFEED DETECTOR

[75] Inventor: August Hoyer, Penfield, N.Y.

[73] Assignee: Xerox Corporation, Stamford, Conn.

[21] Appl. No.: 919,881

[22] Filed: Jun. 28, 1978

[51] Int. Cl.[2] ..... B65H 3/04

[52] U.S. Cl. ..... 271/34; 271/122; 271/125; 271/263

[58] Field of Search ..... 271/34, 35, 122, 125, 271/104, 137, 258, 259, 262, 263

[56] References Cited

U.S. PATENT DOCUMENTS

| | | | |
|---|---|---|---|
| 3,108,801 | 10/1963 | Van Dalen | 271/122 |
| 3,130,394 | 4/1964 | Hinz | 271/258 X |
| 3,272,500 | 9/1966 | Van Dalen | 271/122 X |
| 3,754,754 | 8/1973 | Peterson | 271/122 |
| 4,060,232 | 11/1977 | Gibson | 271/122 |

*Primary Examiner*—Richard A. Schacher
*Attorney, Agent, or Firm*—William A. Henry, II

[57] ABSTRACT

A multifeed detection system is disclosed that includes a drag roll which is in contact with and loaded against a driven feed belt. A slip clutch applies a torque to the drag roll. The drag roll is in synchronism with a constant speed motor that drives the feed belt. A double sheet entering the nip between the drag roll and the feed belt will cause the drag roll to hesitate with the hesitation being detected by a sensor that activates shut-down of the feeding system.

2 Claims, 3 Drawing Figures

MULTIFEED DETECTOR

SUMMARY AND BACKGROUND OF THE INVENTION

This invention relates to paper handling systems, and more particularly, to a duplex copying apparatus which employs a multifeed detection device in a document handling system for pre-collation copying.

Bottom sheet feed devices have been employed as document handling means in the past and have included pressurized air to reduce friction between the bottom sheet and the sheet stack tray and minimize friction between the bottom sheet and sheets immediately adjacent thereto. In order to prevent misfeeds or multifeeds, a tri-roller feed belt has been employed having two stationary rolls and a movable roll, the stationary roll disposed beneath the edge of the sheet stack serving to support the feed belt against the lower sheet for feeding the sheet from the stack, the movable roller being disposed adjacent the aforesaid stationary roller for movement into engagement with the bottom sheet of the stack in the event that a sheet is not forwarded at the proper time under the influence of the belt section above the stationary roller. The displacement of the movable roller increases the surface area of the belt in contact with the bottom sheet of the stack to exert a greater feed force thereon.

Problems encountered during the use of such systems included some misfeeding and multifeeding of sheets which reduced reliability of the systems.

Multifeeds are important to control in document feeders since they directly affect output set integrity if undetected. Multifeeds are significantly more important in automatic document handlers as disclosed herein since they could result in jams, or worse, document damage if undetected.

The present invention is intended to overcome the above-mentioned disadvantages of unreliability in document feeders and comprises a drag roll system which is in contact and driven by the feed belt against an applied torque in the drag roll in the feed mode. The drag roll is synchronized with a motor that drives the feed belt. If a single document enters the nip between the drag roll and feed belt, or if no document is present in the nip, the drag roller will maintain a velocity synchronism with the motor. However, double documents or multi-documents entering the nip will cause the drag roller to hesitate with this resultant change in velocity being detected by a suitable sensor which transmits a shut-down signal, as well as a multi-feed indication to the copier console.

PRIOR ART STATEMENT

Structures are known in the prior that are directed toward detection of multiple sheet feeding. For example, Vernon J. Smith et al. in U.S. Pat. No. 3,948,511, issued Apr. 6, 1976, discloses the use of a slip clutch in the sheet feeding mechanism that will slip when there is no sheet or only one sheet in the nips of adjacent rollers as friction between the rollers or between the rollers and a single sheet will transfer a sufficient torque from the drive means to the slip clutch to cause it to slip. However, when there are two or more sheets in the nip of the rollers, the friction between adjacent sheets will be insufficient to transfer a torque to the clutch to cause it to slip, so that a first set of rollers will remain stationary and thus retain the second and any subsequent sheets at the nip of the rollers, leaving the first sheet to be forwarded by the sheet-feeding device. U.S. Pat. No. 3,754,754 to John Allen Peterson discloses a document handling device that includes a feeding arrangement wherein a pair of rollers are arranged to cooperate in feeding documents in varying size and thickness singly and sequentially from a stack without adjustment of the device. Richard C. Hickey et al. in U.S. Pat. No. 3,937,453 shows a multi-feed detection system where upon detection of more than one document passing through separator rollers, a clutch is energized to cause one of the rollers to rotate in a direction opposite of the other to separate the documents and only allow the top one to be forwarded into a flat, belt transport. Various other multi-sheet feed detection devices are shown in the prior art such as U.S. Pat. No. 3,966,191; 4,034,976; and 4,030,722; however, none disclose the simple and efficient detection system herein disclosed and claimed according to the present invention.

An exemplary embodiment of the present invention is shown and described herein below as incorporated into an otherwise conventional exemplary xerographic apparatus and process. Accordingly, said xerographic apparatus and processing steps need not be described in detail herein since various publications, patents, and known apparatus are available to teach details thereof to those skilled in the art.

BRIEF DESCRIPTION OF THE DRAWINGS

Further features and advantages of the present invention pertaining to the particular apparatus, steps and details whereby the above-mentioned aspects of the invention are attained are included below. Accordingly, the invention will be better understood by reference to the following description and to the drawings forming a part thereof.

DESCRIPTION OF PREFERRED EMBODIMENT

Figure 1:
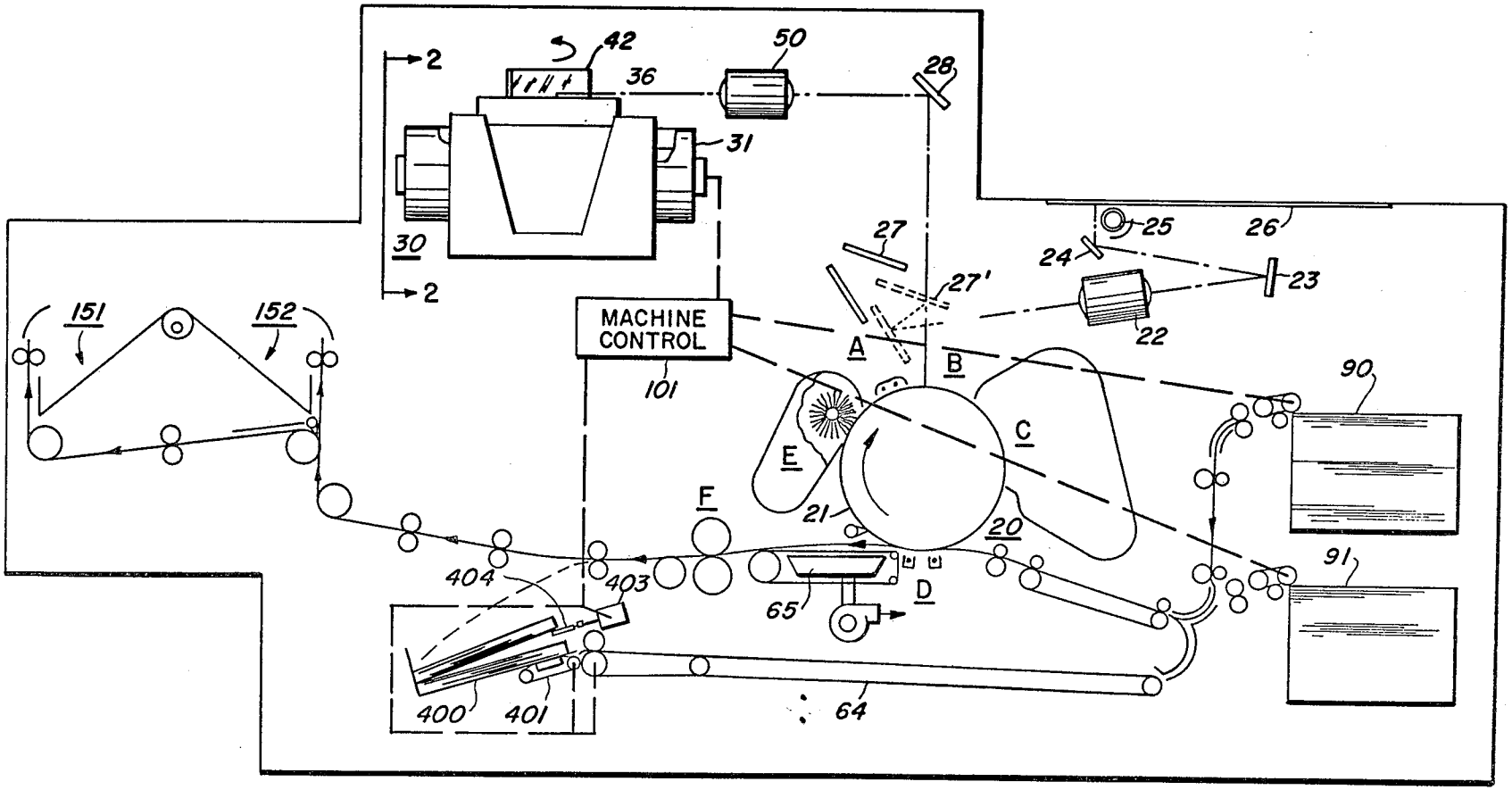
FIG. 1 is a side view of a bi-directional xerographic copying system with collated copy sheet output according to the present invention.

Referring to FIG. 1, there is shown a schematic illustration of an exemplary reproduction machine 10 that employs a document multifeed detection system that will accomplish the objectives of the present invention. It includes a conventional photoconductive layer or light sensitive surface 21 on a conductive backing and formed in the shape of a drum which is mounted on a shaft journaled in a frame to rotate in the direction indicated by the arrow to cause the drum surface to pass sequentially a plurality of xerographic process stations. It should be understood that belt photoreceptor and flash exposure could be used instead of the photoreceptor and exposure means shown in FIG. 1.

For purposes of the present disclosure, the several generally conventional xerographic processing stations in the path of movement of the drum surface may be described functionally as follows:

a charging station A at which the photoconductive layer of the xerographic drum is uniformly charged;

an exposure station B at which a light or radiation pattern of a document could be reproduced is projected onto the drum surface to dissipate the drum charges in the exposed areas thereof, thereby forming the latent electrostatic image of a copy to be reproduced;

a developing station C where xerographic developers are applied to the photoconductive surface of the drum to render the latent image visible;

a transfer station D at which the xerographic developer image is electrostatically transferred from the drum surface to a transfer support material;

a drum cleaning station E at which the drum surface is brushed to remove residual toner particles remaining thereon after image transfer; and a fusing station F at which point the image is fused to the copy paper or support material.

For copying, the xerographic apparatus 10 disclosed herein projects an image from the automatic web scroll document handling apparatus 30 described in U.S. Pat. No. 3,963,345, issued to D. Stemmle and M. Silverberg, which disclosure is incorporated herein by reference.

The document images are projected through lens 50 down from mirror 28 to FIG. 1 onto the photoreceptor 20. The image is developed on the photoreceptor surface 21 and rotated clockwise to a transfer station D. Copy sheets coming from either the main copy sheet feeding tray 90 or the auxiliary sheet feeding tray 91 are fed by a series of sheet feeding rollers to the transfer station D in order to accept the developed image from the photoreceptor drum 20 at the transfer station D. Vacuum stripping means 65 strips the paper from the photoreceptor 20 and transports it toward fuser F so that the image can be fused onto the copy sheet. Thereafter, the copy sheet is transported either to duplex tray 400 or to an output sheet tray 151 or 152. For simplex copies, the duplex tray 400 is not utilized. Documents can be imaged in the apparatus of FIG. 1 either from the automatic document handler or from platen 26.

For uni-directional document copying, all of the sets will be in one output tray. The same output tray 151 is used whether the copies are simplex or duplex. Collation occurs without an inverter. For bi-directional copying, alternate sets are ultimately placed in trays 151 and 152. The forward order copies go into tray 151, and the reverse order copies go into tray 152.

Figure 2:
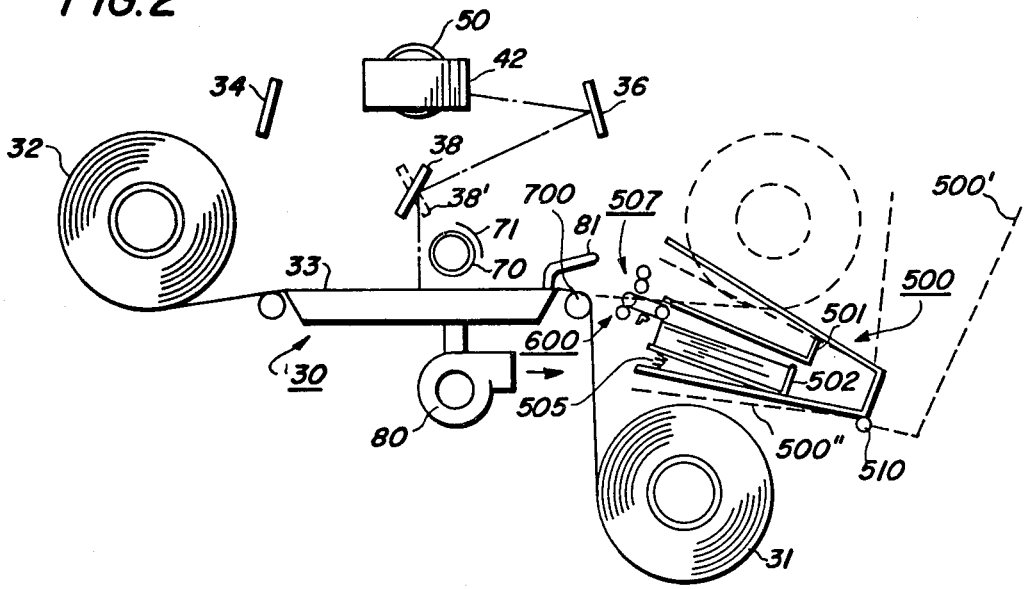
FIG. 2 is a side view taken along side 2—2 of the automatic document handling apparatus shown partly cut away in FIG. 1.

As shown in FIG. 2, documents are loaded by being placed onto web 33 against registration means 81 while scroll 31 is in the load/unload position. As the documents are moved by the automatic document handler (hereinafter called ADH), they are exposed to light directly from exposure lamp means 70 and reflected through reflector means 71 off the document into a bi-directional optical system for projection of the document image onto photoreceptor 20. Each sheet is conveyed passed exposure means 70 and reflector means 71 and wound onto scroll means 32 after scroll means 31 has been moved into recirculation position shown in phantom lines. Subsequently, scroll means 32 is reversed in direction toward scroll means 31 to allow re-exposure of documents wound around in a reverse scan mode.

For the first exposure of the documents on page images on the web, only even numbered documents are imaged, i.e. documents located in the 2, 4, 6, 8, etc. positions on web 33. Depending on whether uni-directional or bi-directional copying is desired, the buffer set is a one-set or two-set buffer, respectively. For uni-directional copying, a fast reverse rewind is accomplished and only one buffer set is required. For bi-directional copying, the even numbered documents are also imaged during reverse movement of the web to create two-buffer sets, one in ascending order (2, 4, 6 . . . ) and one in descending order (8, 6, 4, 2). In either case, copies made from exposure of the even numbered documents are fused at station F and continued in transportion on a conventional conveyor system into buffer tray means 200.

Documents in the ADH are imaged, even numbered documents first on a forward pass of the ADH with the images obtained from the documents being transferred to copy sheets fed from copy sheet tray 90. After the images have been transferred to station D, the one-side imaged sheets are then forwarded toward duplex tray 400. In order to keep job integrity, it is necessary to count sheets of paper or one-sided copies as they come into the duplex tray and count the copies as the egress from the duplex tray. The number of copies in must equal the number of copies out before set separator fingers 404 will retract and allow the next set of one-sided copies to fall into the bottom of the duplex tray 400 in order to be refed for duplexing. A detailed explanation of duplex tray 400 is contained in commonly assigned U.S. application Ser. No. 919,892, filed concurrently herewith under the name of Frank R. Hynes and is incorporated herein by reference.

Figure 3:
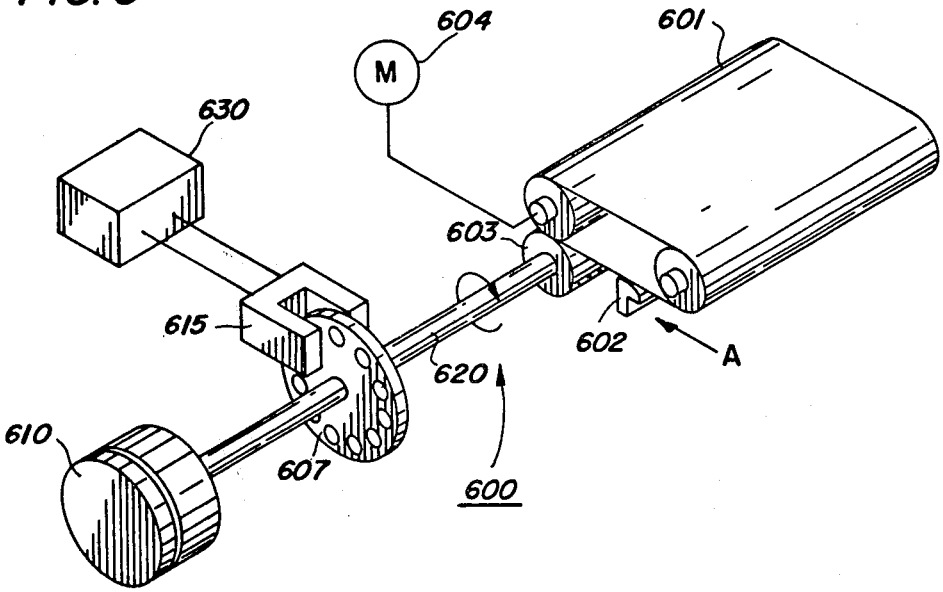
FIG. 3 is a partial schematic top view of the document feeder apparatus of the present invention.

Now referring more particularly to the apparatus of the present invention and FIGS. 2 and 3, it can be seen that document feed tray 500 is operable in three positions as it pivots about shaft 510. In a first position, shown in FIG. 2, in solid lines, documents are fed by document feeder means 600 toward web 33 for imaging on photoreceptor 20. A second position 500', shown in phantom lines, is the machine copying position, as well as the hand load/unload position depending on whether documents are to be removed from tray 501 or placed into tray 502 for feeding onto web 33. The third position 500", also shown in phantom lines, is the document unload position for receiving documents to be removed from web 33. In this position, as web 33 is wound around scroll 31, documents located on the web will separate therefrom as they pass roller 700 due to their beam strength and will be received by separation rollers 507 and transported into document receiving tray 501.

Now turning more specifically to the present invention and FIG. 3, document feeder means 600 is shown that detects multifeeding of documents toward ADH 30 by use of a drag roll system. Documents are fed toward retard pad 602 in the direction of arrow A by feeder belt 601 that is driven by conventional constant speed motor 604. Drag roll 603 is in contact and driven by the feed belt against torque applied to the drag roll by hystersis clutch 610 in the feed mode. The contact between the drag roll 603 and the driven belt 601 accomplishes synchronization between the belt and the drag roll. A single sheet can enter the nip formed between the drag roll and feed belt without disturbing the synchronization. However, a double sheet or multifeed will cause the elastomer drag roll 603 to hesitate because of the difference in coefficient of friction between elastomer on paper and paper on paper. The hesitation of drag roll 603 that is mounted on shaft 620, in a multifeed situation is picked up by a suitable photo-optical sensor 615 that senses a change in velocity of timing disc 607 which is also mounted on shaft 620. The change in velocity results in the generation of a shut-down signal and energization of a suitable multifeed indicator light on the console of copier 10.

It should be understood that while FIG. 3 shows a multifeed detection system that employs photo-optical sensing, many other alternatives for sensing the change in velocity of drag roll 603 are available, such as, magnetic, inductive, capacitive, digital and analog. For example, a tachometer could be placed adjacent a D.C. motor located on the shaft of drag roll 603. A constant drive motor could be attached to drive belt 601. Any change in velocity of the drag roll due to double sheet or multisheet feeding could be monitored by an amplifier having inputs from the D.C. motor and the tachometer. The output from the amplifier through a low pass filter could go through a comparator that would include a reference signal. The output from the comparator could be a double feed signal to shut the copier down. Also, this invention is not limited to document sensing, but is usable in any paper feeding situation where there is a possibility of multi-feeds which might appear as a single sheet, i.e. unshingled.

A programmable machine controller 101 is used to control the operation of document feeder means 600, as well as other xerographic reproduction operations in either the simplex or duplex modes of copier 10, such as, the controller disclosed in U.S. Pat. No. 3,940,210, which is incorporated herein by reference.

In operation, it can be seen that duplex tray means 400, as well as vacuum feed means 401 and transport means 64, are controlled by machine control means 101 with the transport means 64 and vacuum feed means 401 being actuated in response to the completion of a set of one-sided copy sheets entering duplex tray means 400 to feed the set of copy sheets back toward transfer station D for second-side copy. On succeeding passes of the automatic document handler 30, forward and reverse, all documents are imaged with the copy substrates being fed from the copy sheet tray 90 to transfer station D alternately with copy sheets fed from feeding means 401. Copy sheets fed from primary copy sheet tray 90 receive images of even positioned documents in the ADH and are fed to buffer tray means 400 while copy sheets that are fed from feeding means 401 alternate with the sheets fed from the primary copy sheet tray and receives images on the reverse side thereof of odd positioned documents in the ADH and are fed to output station 151 for copy sets made on the forward pass, or station 152 for copy sets made on the reverse pass, so that once a completed, collated set of documents have been collected in the output station, they may be stapled and side stacked or staggered, and they will still read in consecutive ascending order, for instance, 1, 2, 3, 4, 5, 6, etc. On the last pass of web 33 past the exposure station 70, on the odd numbered or positioned documents are imaged. The images are then copied on the back of copies previously made from even numbered documents that are fed by feeding means 401. This process empties feeding means 401 and presents the final set of duplexed copies to the output station. However, if a two-set buffer is used, i.e. if the ADH imaged documents on both the forward and reverse scans are numbered documents (only) are imaged on both of the final forward and reverse scans of web 33 in order to make complete duplexed copies of the two sets of evens adapted for feeding by means 401, in order to finish the duplex run of collated sets with an empty transport means 64 and feeding means 401.

It should be understood that odd numbered documents could be imaged on the first pass of the ADH, however, to do so would require an extra pass of the last copy sheet through the transfer station without putting an image on the even side thereof and the copying of an odd numbered document set, e.g. a set of five documents. Various other ways of using the machine disclosed in use with the present invention are disclosed in U.S. Pat. No. 4,116,558, issued to John A. Adamack and Richard T. Ziehm, which disclosure is incorporated herein by reference as is necessary for implementation of the present invention.

In reference to FIG. 2, an optical system for scanning documents in both directions are relative reciprocal motion between the documents and the optical system shown. The document is first scanned in one direction, then the image orientation is rotated 180° about the axis of propagation for scanning in the reverse direction. Properly oriented images are thus projected onto photoreceptor 20 and move in the same direction during both directions of scan, i.e. moving in the same direction as the photoreceptor surface in both cases without reversing the photoreceptor movement. This is more fully disclosed in commonly assigned U.S. Pat. No. 4,008,958, issued Feb. 22, 1977.

In conclusion, a duplex copying system is disclosed in which page images are formed on both sides of copy sheets by copy processing means one side at a time to form multiple copy sheet sets while employing multifeed detection means in the document feeder. The document feeder of the present invention includes a drag roll that is in contact with a motor driven feed belt. A torque is applied by the drag roll when the document feeder is in the feed mode. As a result of the friction between the drag roll and feed belt, synchronism is maintained therebetween. A double sheet entering the nip between the drag roll and feed belt will cause the drag roll to hesitate and this resultant change of velocity is detected by a suitable sensor which generates a shut-down signal to the copier.

What is claimed is:

1. A sheet feeding apparatus, comprising:
(a) feed belt means for feeding sheets through a feed path;
(b) drive means for driving said feed belt;
(c) first stationary retard means located adjacent said feed belt for forming a nip for the passage of sheets therebetween;
(d) second retard means adjacent to and adapted for frictional engagement with said feed belt, said second retard means being located downstream of said nip formed between said first retard means and said feed belt and in the path of sheets fed by said feed belt means;
(e) a shaft for supporting said second retard means for rotational movement relative to said feed belt;
(f) clutch means for applying a torque to said second retard means; and
(g) sensor means for monitoring any change in movement of said second retard means caused by a multifeed of sheets decreasing the frictional engagement between said second retard means and said feed belt.

2. A method of detecting multifeeds in a copier sheet handling system, comprising the steps of:
(a) providing a feed belt means for feeding sheets through a feed path;
(b) driving said feed belt;
(c) locating a first stationary retard means adjacent said feed belt for forming a nip for the passage of sheets therebetween;

(d) locating a second retard means adjacent to and in frictional engagement with said feed belt, said second retard means situated in a position downstream of said nip formed between said first retard means and said feed belt and in the path of sheets fed by said feed belt means;

(e) providing a shaft for supporting second retard means for rotational movement relative to said feed belt;

(f) providing clutch means for applying a torque to said second retard means; and (g) sensing any change in movement of said second retard means caused by a multifeed of sheets decreasing the frictional engagement between said second retard means and said feed belt.

* * * * *